United States Patent [19]

Kicherer et al.

[11] Patent Number: 4,658,118

[45] Date of Patent: Apr. 14, 1987

[54] ELECTRIC HOTPLATE

[75] Inventors: Robert Kicherer; Stefan Reif, both of Oberderdingen, Fed. Rep. of Germany

[73] Assignee: EGO Elektro-Gerate Blanc u. Fischer, Fed. Rep. of Germany

[21] Appl. No.: 753,430

[22] Filed: Jul. 10, 1985

[30] Foreign Application Priority Data

Jul. 13, 1984 [DE] Fed. Rep. of Germany ..... 3425896

[51] Int. Cl.[4] ..... H05B 3/68

[52] U.S. Cl. ..... 219/451; 219/458; 219/463; 219/541

[58] Field of Search ..... 219/451, 443, 445, 446, 219/449, 452, 453, 457, 458, 459, 463, 464, 436, 467, 351, 541

[56] References Cited

U.S. PATENT DOCUMENTS

| | | | |
|---|---|---|---|
| 1,684,374 | 9/1928 | Nordling | 219/451 |
| 2,101,110 | 12/1937 | Thornton | 219/445 |
| 2,234,132 | 3/1941 | Simpson | 219/451 |
| 2,301,085 | 11/1942 | Smith | 219/451 |
| 2,472,738 | 6/1949 | Backer | 219/451 |
| 3,331,944 | 7/1967 | Burger | 219/451 |
| 3,622,754 | 11/1971 | Hurko | 219/449 |
| 4,122,330 | 10/1978 | Fischer | 219/452 |
| 4,386,263 | 5/1983 | Fischer | 219/452 |
| 4,467,181 | 8/1984 | Fischer | 219/458 |

FOREIGN PATENT DOCUMENTS

| | | |
|---|---|---|
| 1021967 | 6/1958 | Fed. Rep. of Germany . |
| 1270201 | 6/1968 | Fed. Rep. of Germany . |
| 2620004 | 1/1978 | Fed. Rep. of Germany . |
| 2651848 | 5/1978 | Fed. Rep. of Germany . |
| 2933349 | 3/1981 | Fed. Rep. of Germany . |
| 3301219 | 7/1984 | Fed. Rep. of Germany . |

*Primary Examiner*—E. A. Goldberg
*Assistant Examiner*—Teresa J. Walberg
*Attorney, Agent, or Firm*—Steele, Gould & Fried

[57] ABSTRACT

A hotplate is provided on the bottom of its body with a cover plate, through which a lead is passed through an insulator. The stub-like ends of the leads are connected to the outer terminal portions of the multicore cable ends projecting from a positioning part and are squeezed at this point. The multicore cable ends are longer than conventional multicore cable ends.

5 Claims, 9 Drawing Figures

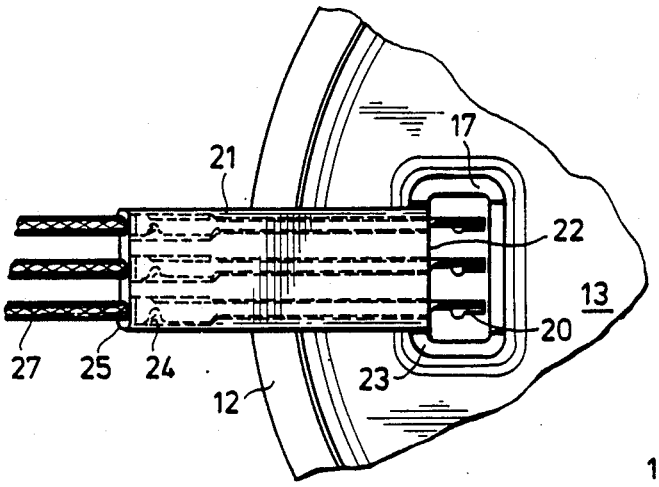
FIG. 1
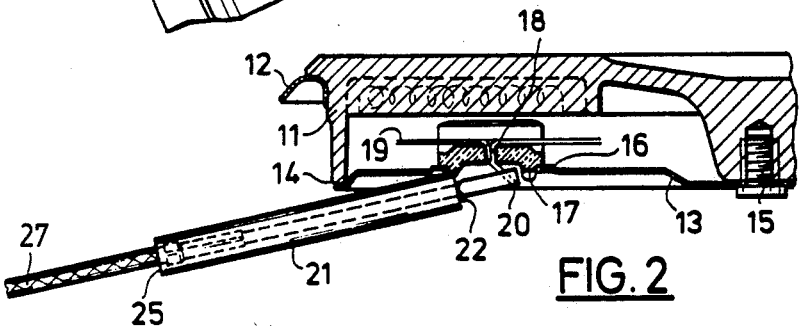
FIG. 2
FIG. 3
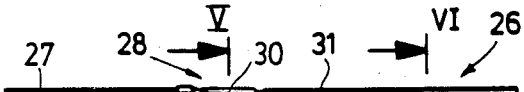
FIG. 4
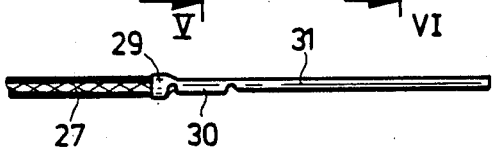
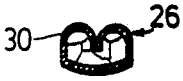
FIG. 5
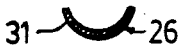
FIG. 6
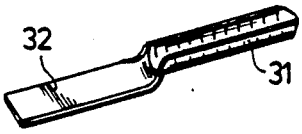
FIG. 7
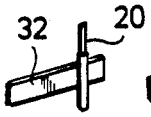
FIG. 8
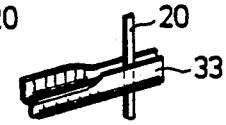
FIG. 9

ELECTRIC HOTPLATE

BACKGROUND OF THE INVENTION

The present invention relates to an electric hotplate with a hotplate body and a lower cover plate through which passes an insulator in the edge area, from which the electric hotplate leads project in a stub-like manner, as well as with a positioning part having spaced passages fixable with respect to the hotplate and in which are fixed the flexible connecting lines provided with multicore cable ends for the connection thereof with the stub-like ends of the leads.

Such an electric hotplate has been proposed in German Patent Application No. P3301219.9, published July 19, 1984.

According to this proposal, the positioning part can be fixed and particularly mounted on the hotplate body. The positioning part can have a number of spaced passages corresponding to the number of leads. The spacing of the passages in the positioning part can correspond to the spacing of the lead wires. The stub-like ends of the leads must not project over the plane formed by the lower edge of the hotplate body. They can be bent down in such a way that they cross the lead wires, preferably accompanied by the formation of a roughly right angle.

This proposal was based on the idea of providing a hotplate particularly suitable for the automatic equipping of cooker trays or cooking stations. It was already provided in said proposal that the connecting lines provided with the multicore cable ends are fixable in the positioning part. To the multicore cable ends are then connected lead wires, which project out of the positioning part and can be connected to the hotplate leads.

SUMMARY OF THE INVENTION

The problem of the present invention is to so improve an electric hotplate of the aforementiond type, particularly an electric hotplate according to the aforementioned German Patent Application, that manufacturing costs are reduced and the possible uses improved. According to the invention this problem is solved in that the multicore cable ends project out of the positioning part on its side facing the insulator and cross the ends of the lead wires. Thus, according to the proposal of the invention no wires are necessary for fitting to the multicore cable ends. This leads to a reduction in the number of components, as well as to a reduction in the number of operating steps. So that the multicore cable ends can project from the positioning part, it is appropriate to use specially constructed relatively long multicore cable ends. The measure according to the invention has the additional major advantage that on interchanging such hotplates with conventional hotplates the lead wires can continue to be used. During such a replacement, the terminal portions of the multicore cable ends projecting from the positioning part are pinched, the multicore cable end is drawn out of the positioning part and shortened to the conventional length with the aid of side-cutting pliers or the like. It is then possible to fit a conventional hotplate with screw connection.

According to a further development of the invention, the multicore cable ends and passages of the positioning part can have two areas with a different diameter and the terminal portions of the cable ends projecting from the positioning part are squeezed. The areas of different diameter ensure that the multicore cable ends with the flexible connecting lines fixed thereto are correctly positioned in the positioning part and the squeezing ensures that the said cable ends remain fixed in position. The squeezing action ensures that there is a particularly favourable enlarged bearing surface between the multicore cable ends and the stub-like ends of the lead wires. Squeezing can take place in such a way that the terminal portions of the multicore cable ends are pressed flat. It is also possible to carry out squeezing with the aid of a bending operation.

According to the invention, the reduced diameter area of the multicore cable ends can have a roughly U or V-shaped cross-section. Such multi-core cable ends can be relatively simply produced from sheet metal blanks, the U or V-shaped cross-section giving a simple possibility of maintaining the diameter of the multicore cable ends smaller in said area. Squeezing of said cross-section outside the positioning part also can be performed very simply.

According to a further development, the reduced diameter area of the multicore cable ends is roughly three times as long as the increased diameter area. It has been found that in this case the multicore cable ends with conventional terminal parts can be used.

It is particularly favourable if, according to a further feature of the invention, the positioning part can be fixed to the insulator. For this purpose the insulator can have a lateral recess, in which the positioning part can be fixed.

BRIEF DESCRIPTION OF THE DRAWINGS

The invention is described in greater detail hereinafter relative to a non-limitative embodiment and the attached drawings, wherein show:

FIG. 1 a partial view from below of a hotplate.

FIG. 2 a cross-section through a hotplate.

FIG. 3 a plan view of an extended multicore cable end.

FIG. 4 a side view of the multicore cable end.

FIG. 5 a larger-scale section through the arrangement of FIG. 3 on line V—V.

FIG. 6 a larger-scale cross-section through the arrangement of FIG. 3 on line VI—VI.

FIGS. 7 to 9 different ways of squeezing the lower terminal portion of a multicore cable end.

DETAILED DESCRIPTION OF THE INVENTION

The hotplate shown in FIGS. 1 and 2 essentially has a hotplate body 11, which is provided on its outside with a spillage rim 12 and on its bottom is covered by a bottom plate 13. The latter rests on the lower edge 14 of the hotplate body and is fixed to the hollow centre pin with the aid of a screw 15. In the vicinity of hotplate edge 14 in cover plate 13, there is a depression 16 with an insulator 17 inserted therein. The insulator has three holes, through which are passed the bare ends of the leads 19 for the heating resistors which are not shown in detail. The ends 20 of the leads 19 are bent slightly in the direction of the centre of the hotplate body below and/or outside the insulator 17 and are cut off, so that they do not project beyond the plane formed by the lower hotplate edge 14.

In the vicinity of insulator 17 is provided a positioning part 21, whose hotplate side end 22 engages in a recess on the edge 23 of insulator 17. Positioning part 21 has three through-bores 24, which have an increased diameter in the vicinity of the hotplate-remote end 25 of positioning part 21. From said side flexible, insulated connecting lines 27 provided with multicore cable ends 26 are inserted in positioning part 21. The shape of the multicore cable ends can be gathered from FIGS. 3 to 6. The three terminal portions of the multicore cable ends 26 project out of the hotplate-side end 22 of positioning part 21 to such an extent that they cross the stub-like ends 20 of leads 19. These terminal portions of the multicore cable ends 26 are pressed flat and the pressed-flat ends are welded to the stub-like ends 20 of the leads, preferably by cross-resistance welding.

FIG. 3 shows the shape of the multicore cable ends 26, which have a first area 28, as in conventional multicore cable ends. In this area, said ends are pressed around the connecting lines 27 and this pressing in the outer part 29 also covers the insulation of connecting lines 27. In the following area 30, said pressing only affects the metal part of connecting line 27, so that here a good electrically conducting connection is obtained. This area 30 is followed by a greatly extended reduced diameter area 31, which forms an extension of multicore cable end 26.

FIG. 5 shows a cross-section through area 30, where pressing takes place between the metal of the multicore cable end 26 and the metal part of connecting line 27.

FIG. 6 shows the section through the reduced diameter area 31, it can be seen that the cross-section in this area is roughly U-shaped. These novel multicore cable ends are passed through the positioning part 21 and their free ends are pressed beyond said part 21.

One pressing possibility is shown in FIG. 7. The outer terminal portion of the multicore cable end 26 is in this case pressed to give a flat area 32, which consequently has a larger diameter than area 31 and is consequently used for fixing the multicore cable end in positioning part 21.

FIG. 8 now shows how the flat part 32 is connected to the end 20 of a lead 19 at right angles thereto. Connection takes place by resistance welding, but other welding types can also be used.

In FIG. 9, the outer terminal portion 33 of the multicore cable end 36 has a slot, so that pressing outside the positioning part 31 leads to two parallel, planar areas, between which is passed and welded the end 20 of lead 19.

Whilst in the represented embodiment there are three holes 18 or three bores 24 in the insulator 17 and in positioning part 21, the number of said holes or bores can be larger or smaller as a function of the particular use.

What is claimed is:

1. An electric hotplate, comprising:

a hotplate body and a lower cover plate with an insulator projecting through the lower cover plate, the insulator having electric hotplate leads projecting outwardly in stub-like manner;

a positioning part having spaced passages, the positioning part being fixable with respect to the hotplate body, the positioning part having flexible connecting lines in the spaced passages, the flexible connecting lines being provided with multicore cable ends for connecting with ends of the leads projecting in stub-like manner, the multicore cable ends projecting from the positioning part on a side facing the insulator and the multicore cable ends crossing the ends of the leads, the multicore cable ends and the spaced passages of the positioning part having two areas with different diameters and wherein terminal portions of the multicore cable ends projecting from the positioning parts are squeezed therein.

2. An electric hotplate according to claim 1, wherein a reduced diameter area of the multicore cable ends has an approximately U-shaped cross-section.

3. An electric hotplate according to claim 1, wherein a reduced diameter area of the multicore cable ends is approximately three times as long as an increased diameter area thereof.

4. An electric hotplate according to claim 1, wherein the positioning part is adapted to be fixed to the insulator.

5. An electric hotplate according to claim 1, wherein a reduced diameter area of the multicore cable ends has an approximately V-shaped cross-section.

* * * * *